US005323803A

United States Patent [19]

Blumenauer

[11] Patent Number: 5,323,803

[45] Date of Patent: Jun. 28, 1994

[54] INSTANT HOT WATER DEVICE

[76] Inventor: Wesley C. Blumenauer, 15744 Tower View Dr., Clermont, Fla. 34711

[21] Appl. No.: 160,060

[22] Filed: Nov. 24, 1993

[51] Int. Cl.[5] ..... F16K 49/00

[52] U.S. Cl. ..... 137/337; 126/362; 137/614.2; 417/12

[58] Field of Search ..... 137/337, 624.12, 563, 137/565; 126/362; 417/12

[56] References Cited

U.S. PATENT DOCUMENTS

| | | | |
|---|---|---|---|
| 2,716,424 | 8/1955 | Watts | 137/337 |
| 2,823,695 | 2/1958 | Coffin | 126/362 |
| 4,331,292 | 5/1982 | Zimmer | 137/337 |
| 5,135,021 | 8/1992 | Pegg | 126/362 |
| 5,183,029 | 2/1993 | Ranger | 137/337 |

*Primary Examiner*—A. Michael Chambers

*Attorney, Agent, or Firm*—Armstrong, Westerman, Hattori, McLeland & Naughton

[57] ABSTRACT

An instantaneous hot water device comprises a gate valve means connected to a hot water line and having a gate valve and a gate valve seat providing a controlled flow of hot water from the hot water line into a ball valve means having a ball check and a first ball valve seat having slot cooperating with the ball check to provide a small, controlled flow of hot water into a cold water line and a second ball valve seat cooperating with the ball check to prevent flow of cold water into the gate valve means and the hot water line.

7 Claims, 3 Drawing Sheets

INSTANT HOT WATER DEVICE

BACKGROUND OF THE INVENTION

1. Field of the Invention

This invention relates to a device for providing instant hot water at a hot water outlet in a home water plumbing system.

2. Description of Related Prior Art

A great deal of water and heating energy are wasted in waiting, after a hot water faucet or other tap is turned on, for the temperature of the water to rise to the temperature provided by a hot water heater. It has been estimated that about 5000 gallons of water per year are so wasted in the average home. When cold water is drained from hot water pipes, additional cold water enters the hot water heater and must be heated. The energy required for heating such wasted water is considerable.

Numerous prior art devices have been developed for providing instantaneous hot water at a hot water tap, for example in residential plumbing systems. In general, such prior art devices comprise expensive and complicated equipment for such purpose.

For example, Peters, U.S. Pat. No. 2,842,155 discloses a device for providing instantaneous hot water at a hot water faucet by interconnecting the hot and cold water lines and permitting a thermally-induced circulation of hot water into the cold water line. The Peters device comprises a control means 25 interconnecting the hot and cold water lines below the faucets. Means 25 comprises a pipe-like housing 27 which is attached at either end to the hot and cold water lines, and a bypass valve 35 which is seatable against and movable away from valve seat 37 under the action of a thermostatic element 31 responsive to water temperature, thus permitting or preventing the flow of hot water through an orifice 39. Cold water is prevented from entering the hot water line by pressure of cold water exerted on a ball valve 43 positioned in a cage 44 and forcing valve 43 against a valve seat 41 formed on cage 44. Thus Peters requires a thermostatically controlled Bourdon tube 80 that depends on the temperature of the hot water to expand and close a plunger 70. Hot water is maintained at a given point by using a pressure and temperature differential. The Peters device will function only as long as hot water is being purged through the hot water side of the faucet. After hot water has been purged, and the faucet is closed, a cooling effect takes place. The Bourdon tube contracts and closes plunger 70. The cross connection is sealed, and thus there is no convection and the hot water line will cool back to the hot water heater. The only time that the Peters device delivers hot water is after the first purge of hot water (approximately 3–5 gallons). It will maintain hot water for approximately 30 minutes only.

Chubb U.S. Pat. No. 1,108,550 has, as a primary use, the warming of waste water in traps under sinks and bath tubs. Such use no longer applies in modern home construction and plumbing systems.

Chubb U.S. Pat. No. 1,247,374 also discloses a device for preventing freezing of a water distribution system, wherein the hot and cold water lines are interconnected by means of an automatic valve 36 or **36*a*. Valve 36 is connected at either end to the hot and cold water lines. Mounted within the valve 36 are valve elements 50 and 51, connected by a rod 52 extending through a restricted passageway 48, and biased by springs 56 and 57**.

In the closed position of the faucets, springs 56 and 57 are so biased that they keep the elements 50 and 51 spaced from the openings to passageway 48 so that hot water can pass into the cold water line. If a faucet is opened, the flow of water is such as to cause element 50 or 51 to compress the respective biasing springs and to close the passageway 48, preventing water from passing therethrough. The Chubb device is designed to work on relatively low temperatures and pressures. Modern high technology, high efficiency water heaters would damage the Chubb device and render it inoperable.

Paulson U.S. Pat. No. 3,543,836 discloses a device for providing instantaneous hot water comprising a pipe 10 interconnecting the hot and cold water lines and forming a closed loop which contains a pump 9 which, on activation, circulates cooled hot water from the hot water line to the cold water lines. The pump is activated by a thermostat 16 positioned in the pipe 10 upstream of the pump and downstream of the connection to the hot water supply line. A signal, equal to the temperature sensed by the thermostat, is transmitted to a temperature controller 17 via a capillary tube 18. Thus Paulson requires a temperature controller to operate a pump on a temperature drop creating a part time delivery of hot water. The device depends on a fan blowing air over a coil to reduce temperature of hot water being moved to the cold water source. The Paulson device is designed for trapped plumbing systems only, so its application is limited. Moreover, the Paulson device in very expensive and is not practical in today's modern systems; it would not be allowed under the plumbing codes of many areas of the United States which prohibit a 110 volt controlling device to be installed under sinks in bathrooms because of the danger of electrical shorts causing injury.

Zimmer U.S. Pat. No. 4,331,292 relates to an instantaneous hot water supply system and comprises a pipe 20 interconnecting the hot and cold water lines. Mounted in pipe 20 is a temperature sensor 15 comprising a U-shaped bimetallic element 17, the free end of which carries a seal 20. Depending upon the temperature in the hot leg of the pipe 20, seal 20 moves into or out of sealing engagement with an orifice 19, permitting or preventing flow of hot water into the cold leg of the pipe 20. A check valve 21 prevents cold water from flowing from the cold leg into the hot leg of pipe 20. Thus, Zimmer requires a thermostatic control device to open or close a seated ball. This device is limited in use and would not apply in a trapped system. A build up of lime deposits on the U-shaped bimetallic member would render it inoperable.

Robillard U.S. Pat. No. 4,672,990 discloses another device for freeze protection of water lines exposed to extreme cold temperatures. This devices requires a mixing tank to receive hot water pumped through a hot water plumbing system through a cross connection. It also requires a thermostatic controller and a remote valve. This system is costly and would waste energy. Lime deposits inside the mixing tank would cause the device to be inaccurate and cause the pump to run longer and waste energy.

Britt U.S. Pat. No. 5,105,846 is directed to an instant hot water system comprising a purge line 25 connected to the hot and cold water lines in which there is provided a pump 28 which can be periodically actuated, e.g. by a timer, to discharge a slug of cool water in the hot water line into the cold water line. A check valve 29 prevents cold water from flowing into the hot water line while allowing water from the hot water line to pass into the cold water line. Thus, Britt requires the use of a third, purge, line to be installed at the back fixture, and a pump. Such an installation is expensive and, practically, Britt is limited to new, modern slab type plumbing systems.

Pegg U.S. Pat. No. 5,135,021 discloses an instantaneous hot water device having a body which is cast in bronze, using a sand core and molding plate. This requires several matching processes to manufacture and is very costly. The device uses a mixing chamber to cross connect the hot and cold water lines through a conduit. In this device it is imperative that the mixing chamber be purged of air or the device will not work. This is done through an air bleed screw. The chamber also becomes a shock absorber and transmits a loud thump when a cold water faucet is opened, causing a pressure drop. Construction is such that installation in close spaces is a problem.

There is a need for an instantaneous hot water device of simple construction, easy to install and of low cost.

SUMMARY OF THE INVENTION

The present invention fulfills such need in the form of a stop element comprising an adjustable gate valve connected to a hot water line and allowing a slight trickle of hot water to pass through the gate valve into a ball valve element connected to a cold water line thus allowing contact between the hot and cold water lines. The device is installed just below a hot water tap, e.g. a faucet, most remote from a hot water heater and thus maintains the elevated temperature of hot water up to where the device is installed and thereby provides instantaneous hot water on opening of a hot water faucet or other tap.

DESCRIPTION OF PREFERRED EMBODIMENTS

Figure 1:
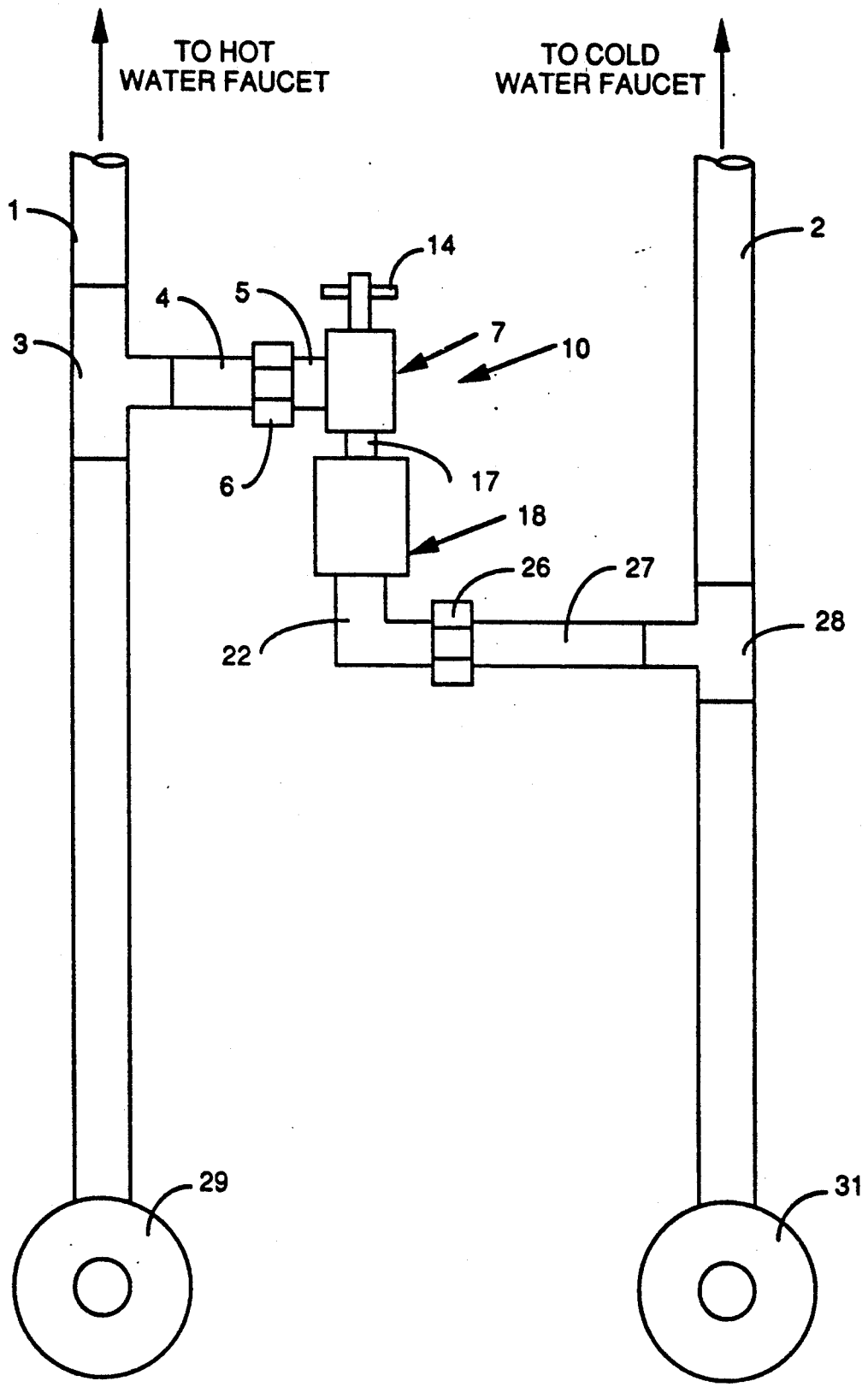
FIG. 1 is a side elevational view of the instantaneous hot water device of the invention installed under a hot water faucet.
Figure 2:
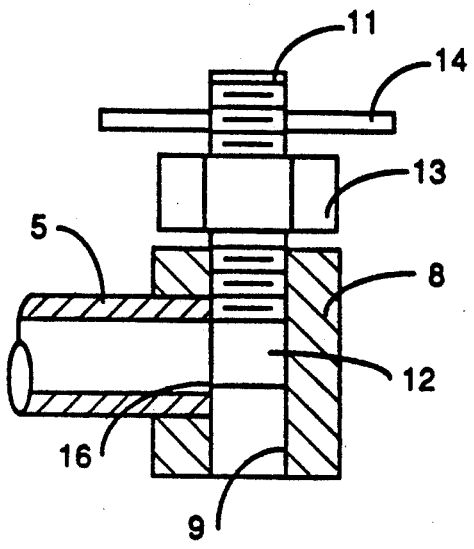
FIG. 2 is a side elevational view, partly in cross section, of the gate valve element of the invention.

In FIG. 1, the numeral 10 generally denotes the plumbing device of the invention. The numerals 1 and 2 denote, respectively, a hot water line and a cold water line to, respectively, hot and cold water faucets in a residential plumbing system wherein a water heater is located on a lower level. The numeral 3 designates a tee, such as a compression or sweat tee, in the hot water line 1 and connected to a line 4 which is connected to a nut 6. Nut 6 is connected to a gate valve means denoted generally by the numeral 7 through a pipe 5. As seen more fully in FIG. 2, means 7 comprises a body 8 having a passageway 9 in which there is threadedly mounted a rod or screw 11 having at one end thereof a cylindrical gate 12 preferably having a rounded or tapered end adapted to seat against a gate valve seat in the body 8. Rod 11 also is threadedly mounted in a nut 13 for strengthening and ease of connection to body 8, and is provided with a handle 14 for ease of turning the rod 11. Advancement or retraction of rod 11 in body 8 varies the size of an opening 16 between passageway 9 and the interior of pipe 5, thereby varying the volume of hot water which may pass from line 5 into the interior of body 8.

Figure 3:
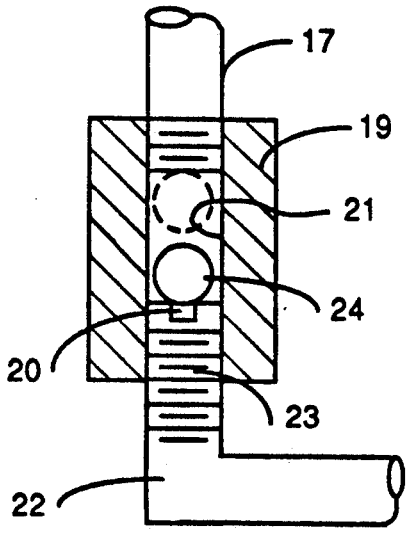
FIG. 3 is a side elevational view, partly in cross section, of the ball valve element of the invention.

Means 7 is connected, through pipe 17, to a ball valve means denoted generally by the numeral 18. As seen more fully in FIG. 3, means 18 comprises a body 19 having an internal bore 21. An elbow 22 is threadedly connected at one end thereof, as at 23, to the lower end of bore 21. A slot 20, e.g. of 3/32 inch width, is machined into the elbow end 23. A ball check 24 is mounted inside the bore 21 and, in the upright installed operative position, seats against the elbow end 23. Elbow 22 is connected, through a nut 26 to a line 27, which is connected, through a tee 28, to cold water line 2. If pressure of cold water from line 27 increases above a predetermined value, the ball 24 is movable upwardly to seat against the lower end of pipe 17, as shown in dashed lines in FIG. 3, to prevent cold water from entering the hot water side.

Hot water line 1 is provided with a hot water shut-off 29 and leads, above the instantaneous hot water device, to a hot water faucet (not shown). Cold water line 2 is provided with a cold water shut-off 31 and leads, above the instantaneous hot water device, to a cold water faucet (not shown).

In operation, handle 14 is turned to provide an opening 16 between the interior of hot water pipe 5 and passageway 9 of the gate valve body 8. Since the controlling parameters vary from installation to installation, no particular spacing is applicable to all installations. In any case, adjustment is made so that only a very slow trickle of hot water can enter the body 8, e.g. about one cupful or less per hour. Due to a slightly higher pressure on the hot side of device 10, the small trickle of hot water passes into the body of ball valve body means 19, around the ball 24 and through the slot 20 and thence into elbow 22 and cold water line 27. Thereby the temperature of the hot water in line 1, up to the point of installation of device 10, is maintained at full elevated temperature as provided by a hot water heater.

Figure 4:
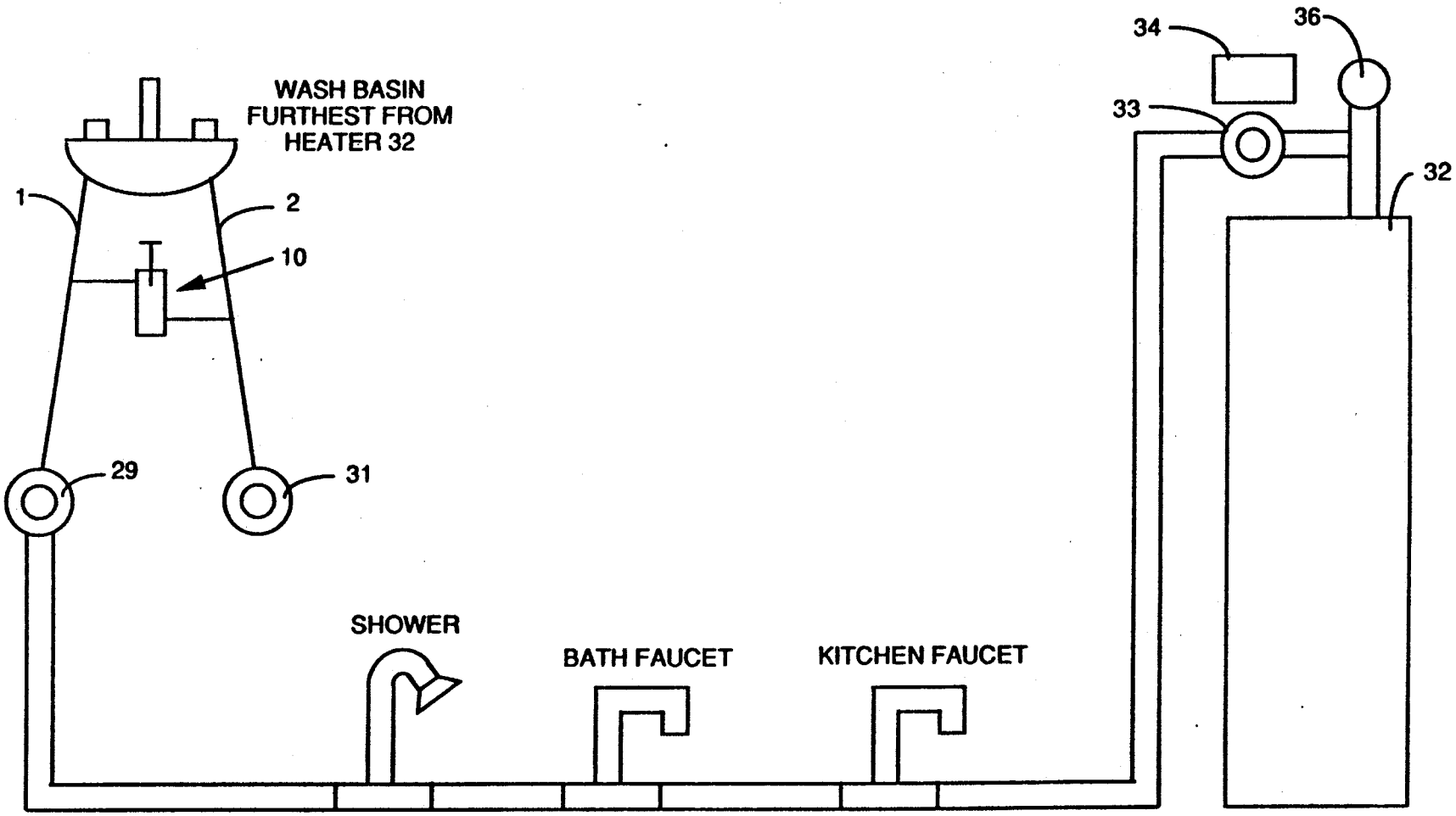
FIG. 4 is a schematic diagram of the device of the invention installed under a hot water faucet in a plumbing system in which the hot water heater is on the same level as the faucet to which instantaneous hot water is to be provided.

If, as shown in FIG. 4, the device 10 of the invention is installed at a location where the hot water plumbing runs below the water heater 32, it is necessary that a pump 33 and timer 34 also be installed. The booster pump allows the heat transfer process to continue, and the timer allows the pump to run for a selected number of minute increments, depending upon the length of the piping run, during peak periods of hot water consumption. In FIG. 4, the numeral 36 denotes a heater relief valve.

The device of the present invention is of simple construction, preferably of machined brass, is easy to manufacture and install, and is of low materials and installation cost. The only materials needed for installation are the device 10 itself, two ⅜ inch tees and a short length of ⅜ inch malleable copper pipe. The inventive device allows an upward heat transfer through the hot water plumbing run from the hot water heater to the point where the device 10 is installed. By placing the device under the wash basin or other hot water tap furthest from the hot water heater, all hot water taps located between the water heater and the device have access to immediate hot water. The device serves a needed savings of energy otherwise wasted in heating additional water while waiting for hot water to issue from an open hot water tap. Thus, in addition to savings of water, hot water heater performance is improved. Typical installation is at the end of the hot water plumbing runs in homes with basements and two or more stories or of split level construction. With the addition of the described timer and pump, the invention can also be used in single storey homes with the hot water piping running under the floor.

What is claimed is:

1. An instantaneous hot water plumbing device comprising a gate valve body having an elongated passageway extending therethrough, a connection on the gate valve body for connecting the passageway with a hot water line, a gate valve seat adjacent one end of the passageway, a threaded rod rotatably mounted in the gate valve body for movement along the passageway toward and away from the gate valve seat, a cylindrical gate valve formed on one end of the rod and adapted to seat against the gate valve seat, a handle on the other end of the rod for ease in turning the rod and adjusting the size of an opening between the gate valve seat and the gate valve, a ball valve body having an elongated bore extending therethrough and connected at one end to a cold water line by a first pipe having one end thereof extending into said bore and provided with a slot and forming a first ball seat, the bore being connected at the other end to the passageway in the gate valve body by a second pipe having one end thereof extending into the bore and forming a second ball seat, a ball check mounted in the bore and adapted, in an upright position of the device and under a predetermined pressure of hot water in the second pipe, to seat against the first ball seat and to prevent flow of hot water into the first pipe except through the slot, and, when pressure of cold water in the first pipe exceeds a predetermined value, to seat against the second ball seat and prevent flow of cold water into the second pipe.

2. A device according to claim 1, wherein the gate valve has a rounded or tapered end to accommodate its seating in the gate valve seat.

3. A device according to claim 2, wherein the slot has a width of about 3/32 inch.

4. A device according to claim 3, wherein the hot water connection to the gate valve body extends substantially normal to the length of the passageway in the gate valve body.

5. A device according to claim 4, wherein the gate valve seat is formed by a second end of the second pipe which extends into the passageway in the gate valve body.

6. A device according to claim 5, wherein the first pipe is connected to a cold water line through a substantially 90 degree bend in the first pipe and extending in an opposite direction to the hot water connection to the gate valve body.

7. A device according to claim 5, wherein the rod is additionally threaded through a nut adjacent the gate valve body.

* * * * *